United States Patent [19]

Mercil

[11] Patent Number: 4,498,608

[45] Date of Patent: Feb. 12, 1985

[54] MOISTURE ABSORBENT CONDIMENT CONTAINER

[76] Inventor: Robert A. Mercil, Star Rte., Box 315, Wetmore, Mich. 49895

[21] Appl. No.: 365,624

[22] Filed: Apr. 5, 1982

[51] Int. Cl.[3] ..... B67D 5/58

[52] U.S. Cl. ..... 222/190; 222/196.1; 222/556

[58] Field of Search ..... 222/190, 196, 196.1, 222/196.2, 142.1, 142.5, 556, 562, 565

[56] References Cited

U.S. PATENT DOCUMENTS

| | | | |
|---|---|---|---|
| 813,649 | 2/1906 | Jones | 222/190 |
| 2,362,796 | 11/1944 | Boesel | 312/31.1 |
| 2,588,600 | 3/1952 | Young | 222/190 |
| 2,592,162 | 4/1952 | Luce | 222/190 |
| 2,596,763 | 5/1952 | Crowley | 222/23 |
| 2,604,237 | 7/1952 | Weddell et al. | 222/190 |
| 2,645,542 | 7/1953 | Munch | 312/31.1 |
| 3,303,973 | 2/1967 | Dootson | 222/190 |

*Primary Examiner*—Joseph J. Rolla
*Assistant Examiner*—Michael S. Huppert
*Attorney, Agent, or Firm*—Paul H. Gallagher

[57] ABSTRACT

A container for condiments, including a body with a closure cap having a space for absorbent material, and a perforated disc holding the absorbent material in the cap. The body also has a perforated disc enabling the condiment to be shaken therethrough. When the closure cap is in closed position the entire interior space is closed to the exterior, and the moisture in the condiment is enabled to pass through the perforated discs and be absorbed by the absorbent material. In one form, the closure cap is held by screw threads and is entirely detachable, and in another case, the cap is yieldably moved to open position, although still attached, and is automatically moved back to closed position when released. In this case, interfitting elements center the cap on the body. The absorbent material includes various kinds of rice, and a selection of chemical materials.

2 Claims, 11 Drawing Figures

MOISTURE ABSORBENT CONDIMENT CONTAINER

OBJECTS OF THE INVENTION

A broad object of the invention is to provide a novel condiment container with construction for holding absorbent material for absorbing the moisture from the condiment and thereby enabling the condiment to flow freely.

A more specific object is to provide a condiment container construction of the foregoing character having the following features and advantages:

(1) It holds a great amount of absorbent material in overall confines that are similar to ordinary containers;

(2) It is especially effective for enabling moisture to pass from the condiment to the absorbent material;

(3) It is extremely simple in construction rendering it simple to use and inexpensive to manufacture;

(4) It includes a special construction enabling the condiment to be shaken out, such as salt;

(5) The device may be made in different forms,—it includes a cap for containing an absorbent material, and in one form the cap has a plain exterior and is entirely removable, and in another form the cap is attached to the container but manually movable, by applying one's finger, to an open position and it automatically closes when released;

(6) The device includes a special construction including a container body and a cap thereon wherein the cap is capable of holding a quantity of absorbent material, and the body is designed for including an additional container for absorbent material within the body itself;

(7) The container utilizes both (a) rice, in different forms, and (b) chemicals of different kinds.

DESCRIPTION OF A PREFERRED EMBODIMENT

As used herein, condiment is a broad or generic term, including such materials as sugar, salt, spices, or other material that do not readily flow when moist, and which it is desired that do readily flow. As used herein, absorbent material includes any of various items used in connection with the condiment, for absorbing moisture from those condiments, and it includes rice, or any of the various chemical materials, as referred to again hereinbelow.

Figure 1:
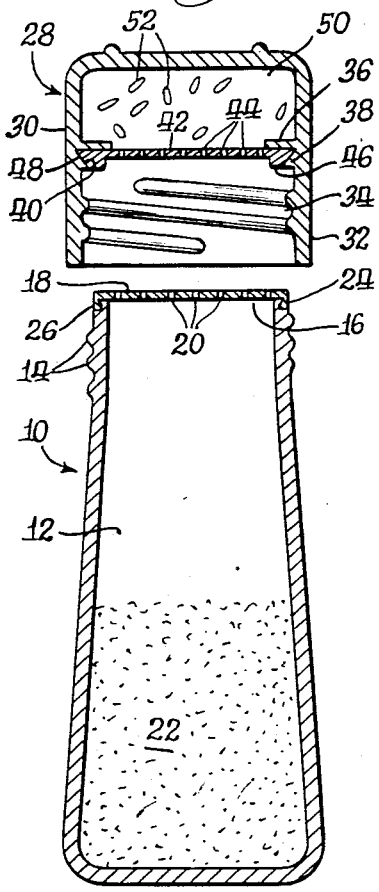
FIG. 1 is a sectional view of a condiment container including features of the present invention, having a body and cap, with the cap in detached position.

Referring in detail to the drawings, FIG. 1 shows a condiment container made according to the present invention, and constituting one embodiment thereof. In this figure the numeral 10 indicates a body which may also be termed a container proper, and is in the form of a jar, having an interior space 12. The body 10 may be similar to that of an ordinary salt shaker, and at its upper end is provided with exterior threads 14, and it has an opening 16 at its upper end. The opening is normally closed by a perforated disc 18 having perforations 20 of sufficient size to enable the condiment, for example salt, 22 to pass therethrough upon shaking the body with its normally upper end down. The disc 18 is provided with a bead 24 around its periphery on the under side thereof, which snap fits into a corresponding circumferential cut out or groove 26 formed in the body. The disc 18 is snapped in place and when in such place, it forms a planar top surface, preferably to the radially outermost limits.

The container shown in FIG. 1 includes a cap 28 having a surrounding wall 30, a substantial portion of which constitutes a skirt 32 of substantial axial length. The skirt 32 is provided with interior threads 34, and the inner surface of the cap is provided with an annular inwardly extending rib 36 preferably of substantial radial dimension, and the skirt 32 immediately thereunder is provided with an annular bead 38 shaped to form a groove 40, between itself and the rib 36, V-shaped in cross section, converging radially outwardly.

Another perforated disc is shown at 42 having perforations 44 therein, and is provided with a circumferential bead 46 on its under surface having a V-shaped outer edge 48 corresponding to the groove 40. The disc 42 is snap-fitted into the groove and normally held therein. The disc 42 forms an interior space 50 in the cap in which is placed the absorbent material 52 which in FIG. 1 is represented as grains of rice.

The cap is fitted on the body by threading it thereon, by the threads 14, 34 and when it is tightened down the bead 46 of the disc 42 fits tight against the peripheral edge of the perforated disc 18 (FIG. 2), forming a continuous space in the container from the space 12 in the body to the space 50 in the cap, although through the apertures 20, 44, and this space is sealed from the exterior.

Figure 2:
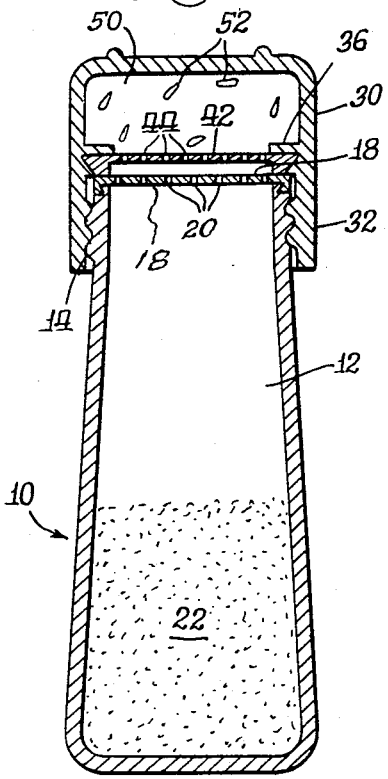
FIG. 2 is a view similar to FIG. 1 with the cap in closed position.
Figure 3:
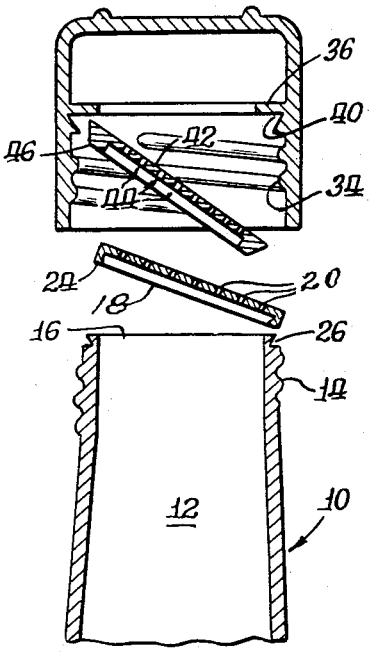
FIG. 3 is a view of the upper portion of FIG. 1 showing the perforated discs removed from their normal working position.

FIG. 3 shows the perforated discs 18, 42 in detached position, and indicate the manner in which they are placed in position and removed therefrom. In the use of the device of FIG. 2, the user removes the cap and up-ends the body and shakes the contents, or condiment, therefrom through the perforations 20 as indicated above. Upon completion of that step, the cap is merely replaced by threading it onto the body. While the cap extends down over the upper end of the body a substantial extent, the upper portion of the cap of course extends above the height of the body, providing the space 50 to contain the absorbent rise therein. This results in a total construction which is only a small amount larger then other normal salt shakers and condiment containers. The container of FIGS. 1–3 is designed primarily as a throw-away article, although of course it could be re-used if desired.

Figure 4:
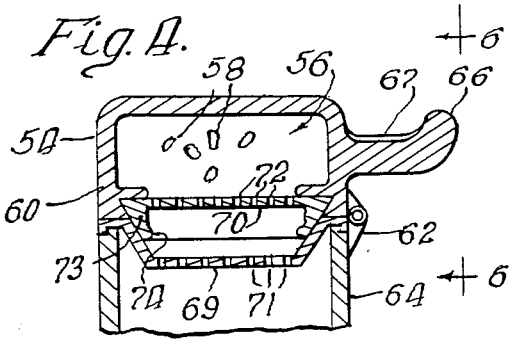
FIG. 4 is a sectional view of the upper portion of the container in a modified form, with the cap in closed position.
Figure 5:
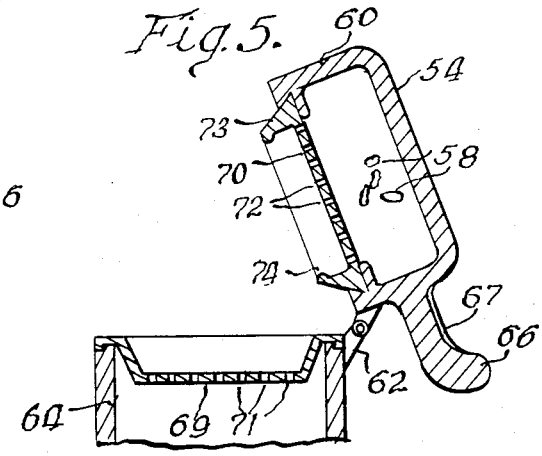
FIG. 5 is a view of the device in FIG. 4 with the cap in the open position.
Figure 6:
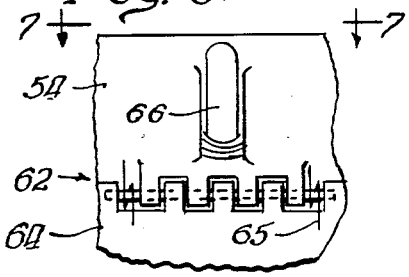
FIG. 6 is a detail view of a hinge as viewed from line 6—6 of FIG. 4.
Figure 7:
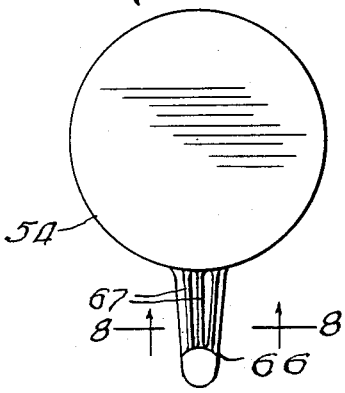
FIG. 7 is a fragmentary view taken at line 7—7 of FIG. 6.
Figure 8:
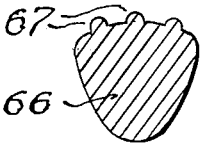
FIG. 8 is a cross sectional view taken at line 8—8 of FIG. 7.
Figure 9:
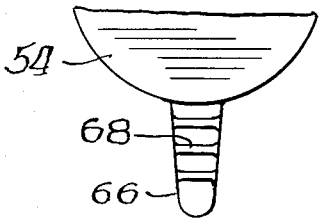
FIG. 9 is a view oriented according to FIG. 7 of a modified form.

FIGS. 4–6 show a modified form of device. In this form, the cap 54 is provided with an interior space 56 for the absorbent material 58. The cap 54 is similar to the cap 28, of FIG. 1, except that the skirt 60 thereof is short and is not threaded, and is preferably the same diameter as the top of the body. Hinge means 62 mounts the cap on the body 64 which is similar to the body 10, except of course without threads. The hinge means 62 as indicated in FIG. 6 is provided with coil spring means 65 for biasing the cap to closed position and normally retaining it there, but yielding to enable the cap to be moved to open position (FIG. 5) by the hand, and when released, the spring means moves it to closed position. Preferably the cap 54 is provided with a tab 66 for gripping by the thumb or finger for manipulating the cap; the tab is preferably provided with friction ribs 67 which may be arranged longitudinally as in FIGS. 7 and 8, or transversely as at 68 in FIG. 9.

In the form of FIGS. 4–6, perforated discs 69, 70 are provided, corresponding to the discs 18, 42, but in this case, the disc 69 is dish shaped, depressed into the container, and the lower portion is provided with apertures 71. The disc 70 has apertures 72 and a depending circumferential flange 73, the latter terminating in an inturned bead 74 which facilitates removal of the disc for replacement or cleaning. In the closing movements of the cap, the flange 73 fits into the dished portion of the lower disc 69, centering the cap and retaining it in centered position. In this case also, the perforated disc 70 seats tight on the perforated disc 69 and seals the two interior spaces against the exterior.

Figure 10:
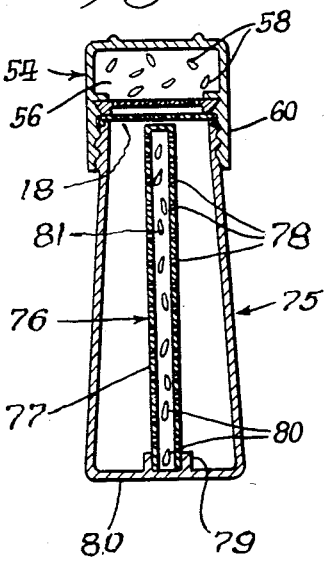
FIG. 10 is a sectional view similar to FIG. 2, but showing a modified form.

FIG. 10 shows the utilization of the construction for incorporating an additional absorbent material container in the device. The container 75 may be identical with the container of FIG. 1, except that an additional container 76 for absorbent material is incorporated therein. This container 76 is similar to that of my prior and co-pending application, Ser. No. 208,884, filed Nov. 21, 1980, U.S. Pat. No. 4,387,803, dated June 14, 1983. It is the form of a tube 77 having perforations 78 therein and mounted in a tubular boss 79 in the floor 80. Absorbent material 81 is placed in the tube. The perforated disc 18 is at the extreme top of the body, and actually at the exterior thereof, leaving the entire interior space unimpeded, and maximum space is provided for the tube 76 which may extend up to the position closely adjacent the perforated disc 18.

Figure 11:
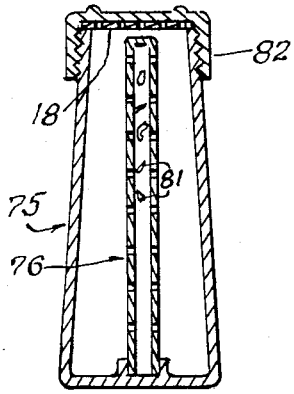
FIG. 11 is a sectional view similar to the view of FIG. 10, showing another modified form.

FIG. 11 shows a container similar to that of FIG. 10, including the inner container 76, but includes a cap 82 that is plain, that is, without an interior space, or upper perforated disc, and is threaded onto the body.

Rice is found to be an excellent absorbent material for the present purpose. Rice can absorb about $4\frac{1}{2}\%$ of its own weight in water. I have found that the best form of rice for the purpose is Minute Rice (a trademark of other than applicant's). Other kinds of rice will also serve well as absorbent materials, such as medium grain white rice, extra long grain rice, and long grain rice and wild rice of a kind known as "Uncle Ben's" (a trademark of other than applicant's), found on the market. Rice being a natural item, is preferred, and it has further advantages, in that it is inexpensive, and even if particles of it should be consumed, no serious consequences follow. Even if it should be desired to replace the rice, the upper perforated disc, such as the disc 42, is easily removed from the cap, for removing the old rice and replenishing it with new rice. Additionally the condiment can be easily placed in the body 10 by removing the lower perforated disc, such as the disc 18, and again replacing it. When the cap is removed, either completely as in the form of FIGS. 1–3, or merely swung to open position as FIGS. 4, 5, the container can be easily used as in the case of any other container heretofore known, the cap not in any way interfering with or affecting the use of the body 10 itself.

While rice is considered the preferred form of absorbent material, certain chemical materials may be used instead of rice, for example, dried silica gel, magnesium sulfate, calcium sulfate and sodium sulfate. Dried silica gel is most effective, this material being capable of absorbing about 5% of its own weight in moisture. While the chemical materials mentioned are less preferred than the natural product, rice, they are nevertheless effective for the purpose intended. In the use of chemical materials, it is so used in the form of large particles, substantially larger than the perforations in the discs, whereby to preclude movement of the particles into the condiment and consequently maintain the condiment in pure form.

I claim:

1. A condiment container comprising, a body forming a container proper in the form of a jar having an interior space and an opening at the top of substantial width relative to the width of the jar, a first perforated disc detachably secured to the jar in position extending across the opening, enabling gases to pass freely through the perforations thereof while enabling particles of condiment in the jar to pass therethrough in response to shaking the jar in inverted position, a cap having an open end and a closed end and movable between a closed position closing the opening and having its open end directed to the jar in that position, and an open position exposing the opening, the cap being of a width similar to the width of the jar, a second perforated disc detachably secured in and carried by the cap and positioned therein so that when the cap is in closed position it is adjacent to and parallel with the first perforated disc, the cap being of such dimensions and the second perforated disc being so positioned in the cap, as to form an interior space therein between the second perforated disc and the closed end of the cap, for containing an absorbent material, the two discs enabling the passage of gases and vapors therethrough between the two interior spaces for carrying of moisture from the condiment to the absorbent material, and the discs being so positioned that when the cap is in closed position, they interengage and seal the interior spaces against the exterior, hinge means mounting the cap on the container proper, and the first perforated disc in the jar being dish shaped and extending into the interior of the jar, and the second perforated disc in the cap including a depending flange which, when the cap is in closed position, extends into the dish shaped first perforated disc, and operates to locate the cap in centered position.

2. A condiment container according to claim 1 wherein, said depending flange is annular in shape, and is provided with an internal head capable of being grasped by the fingers for facilitating removal of the disc from the cap.

* * * * *